US007322322B2

(12) United States Patent
Tsutsui

(10) Patent No.: US 7,322,322 B2
(45) Date of Patent: Jan. 29, 2008

(54) STRATIFIED-SCAVENGING TWO-STROKE INTERNAL COMBUSTION ENGINE

(75) Inventor: Kazuhiro Tsutsui, Hachioji (JP)

(73) Assignee: Kioritz Corporation, Tokyo (JP)

( * ) Notice: Subject to any disclaimer, the term of this patent is extended or adjusted under 35 U.S.C. 154(b) by 23 days.

(21) Appl. No.: 11/493,337

(22) Filed: Jul. 26, 2006

(65) Prior Publication Data

US 2007/0028868 A1 Feb. 8, 2007

(30) Foreign Application Priority Data

Aug. 5, 2005 (JP) ..... 2005-228017

(51) Int. Cl.
*F02M 25/08* (2006.01)

(52) U.S. Cl. ..... 123/73 PP; 123/65 P

(58) Field of Classification Search ..... 123/65 A, 123/65 P, 73 AA, 73 PP
See application file for complete search history.

(56) References Cited

U.S. PATENT DOCUMENTS 6,289,856 B1 9/2001 Noguchi
6,571,756 B1 6/2003 Rosskamp et al.
6,718,917 B2 * 4/2004 Andersson et al. ..... 123/73 PP
6,889,637 B2 * 5/2005 Rosskamp ..... 123/73 PP

* cited by examiner

*Primary Examiner*—Noah P. Kamen
(74) *Attorney, Agent, or Firm*—Kilyk & Bowersox, P.L.L.C.

(57) ABSTRACT

In a stratified-scavenging two-stroke internal combustion engine, air-fuel mixture outlets (14*b*) and air outlets (15*b*) are provided on either side of a cylinder (3), and the air-fuel mixture outlets (14*b*) and the air outlets (15*b*) communicate with a crank chamber (6) via air-fuel mixture passageways (14) and air passageways (15). The crank chamber (6) is charged with air from an air-feeding port (12). An inlet port (10) is disposed on either side of the air-feeding port (12), and mixture (M) from each inlet port (10) is charged into the air-fuel mixture passageways (14) via air-fuel mixture introduction recesses (17) formed in the outer surface of a piston (2). The air outlets (15*b*) are positioned nearer to the exhaust port (11), while the air-fuel mixture outlets (14*b*) are positioned nearer to the inlet ports (10). In the exhaust stroke, the cylinder chamber (7) is scavenged via air (A) supplied from the crank chamber (6) through the air outlets (15*b*) and interposed between the combustion gas (E) in the cylinder chamber (7) and the mixture (M) from the air-fuel mixture outlets (14*b*).

8 Claims, 5 Drawing Sheets

STRATIFIED-SCAVENGING TWO-STROKE INTERNAL COMBUSTION ENGINE

BACKGROUND OF THE INVENTION

1. Field of the Invention

The present invention relates to a stratified-scavenging two-stroke internal combustion engine.

2. Related Background Art

The so-called piston-ported two-stroke internal combustion engine has an exhaust port to exhaust combustion gas from a cylinder chamber, inlet port to introduce an air-fuel mixture into a crank chamber, and scavenging passages communicating with the cylinder chamber and crank chamber. These exhaust and inlet ports and scavenging passages are closed and opened by a piston moving up and down.

In the two-stroke internal combustion engine of this type, the cylinder chamber is scavenged by introducing the air-fuel mixture from the crank chamber into the cylinder chamber through the scavenging passageways during the exhaust stroke. Thus, at the time of scavenging, the "blow-by of air-fuel mixture" phenomenon is liable to occur, in which the air-fuel mixture is exhausted to the outside of the engine through the exhaust port without contributing to the combustion. Because of this "blow-by" phenomenon, piston-ported two-stroke internal combustion engines used in many hand-held power working machines involve the problem that it is difficult to reduce harmful substances in their exhaust gas.

To prevent the "blow-by" phenomenon, stratified-scavenging two-stroke internal combustion engines have been proposed as in International Patent Publication WO 98/57053 (hereafter referred to as "Patent Document 1") and U.S. Pat. No. 6,571,756 (hereafter referred to as "Patent Document 2"). Patent Document 1 proposes that the air-fuel mixture is to be introduced into the crank chamber while air for scavenging is introduced near the scavenging ports of the scavenging passageways to charge the latter with the air. According to the invention disclosed in Patent Document 1, when the piston forced to descend by combustion of fuel opens the exhaust port and starts the exhaust stroke, fuel-free air in the scavenging passageways is introduced from the scavenging passageways into the cylinder chamber, which is thus scavenged. Then the air-fuel mixture in the crank chamber is charged in the cylinder chamber through the scavenging passageways.

Patent Document 2 proposes that the air-fuel mixture is to be introduced into the crank chamber as in Patent Document 1 while scavenging (fuel-free) air is introduced into the cylinder chamber through a reed valve. Also, that document proposes that the air-feeding port formed in the cylinder wall to discharge air into the cylinder chamber through the reed valve is to be disposed on the side of the exhaust port while the air-fuel mixture port also formed in the cylinder wall to discharge the air-fuel mixture from the crank chamber into the cylinder chamber is to be disposed in a position away from the exhaust portion.

According to the invention disclosed in Patent Document 2, the piston forced to descend by combustion of fuel opens the exhaust port and starts the exhaust stroke, while fuel-free air is introduced from the air-feeding port into the cylinder chamber and the air-fuel mixture is introduced from the crank chamber into the cylinder chamber through the air-fuel mixture port. Since the air-feeding port is disposed nearer to the exhaust port than the air-fuel mixture port, the air flowing from the air-feeding port into the cylinder chamber forms an air layer between the combustion gas in the cylinder chamber and the air-fuel mixture flowing into the cylinder chamber from the air-fuel mixture port. The air layer prevents occurrence of "blow-by of the air-fuel mixture" during scavenging.

The aforementioned piston-ported two-stroke internal combustion engine is lightweight because it is simple in structure. This type of engine provides a relatively high output. Thus, the two-stroke internal combustion engine is used as a source of power in hand-held tools such as brush cutters, chain saws, etc. which should be lightweight and compact. On this account, more and more two-stroke internal combustion engines are made from an aluminum alloy. However, a piston made from a light metal such as aluminum alloy should appropriately be protected against overheating.

It is therefore desirable to overcome the above-mentioned drawbacks of the related art by providing a stratified-scavenging two-stroke internal combustion engine in which the "blow-by of the air-fuel mixture" can effectively be prevented and the piston can be cooled appropriately.

It is also desirable to provide a stratified-scavenging two-stroke internal combustion engine in which a necessary and sufficient amount of air can be used for scavenging the cylinder inside.

SUMMARY OF THE INVENTION

According to the present invention, there is provided a stratified-scavenging two-stroke internal combustion engine including a cylinder and a piston fittingly inserted in the cylinder. According to embodiments, the engine can comprise a cylinder chamber and crank chamber defined by the piston; air-fuel mixture passageways having air-fuel mixture outlets open at the cylinder chamber and providing communication between the cylinder chamber and crank chamber; air passageways having air outlets open at the cylinder chamber and providing communication between the cylinder chamber and crank chamber; an air-feeding port to feed air to the crank chamber; inlet ports to supply an air-fuel mixture from the air-fuel mixture outlets to the air-fuel mixture passageways through air-fuel mixture introduction recesses formed in the outer surface of the piston; and an exhaust port disposed opposite to the air-feeding port when viewed in a plane to exhaust combustion gas in the cylinder chamber to outside. According to embodiments, all the air-fuel mixture outlets, air outlets, air-feeding port, inlet ports and exhaust port can be opened and closed by the piston. According to embodiments, the air-fuel mixture outlets can be disposed on the side of the inlet ports, while the air outlets are disposed on the side of the exhaust port, and during the compression stroke, air can be charged from the air-feeding port into the crank chamber, while the air-fuel mixture is charged from the inlet ports into the air-fuel mixture passageways through the air-fuel mixture introduction recesses in the piston and air-fuel mixture outlets. According to embodiments, during the exhaust stroke in which the exhaust port is opened, the air passageways and air-fuel mixture passageways can be opened so that air is supplied into the cylinder from the crank chamber through the air passageways and the air outlets to interpose between the air-fuel mixture having entered into the cylinder chamber from the air-fuel mixture passageways through the air-fuel mixture outlets and the combustion gas in the cylinder chamber.

That is, the present invention includes in one regard an air-feeding port that is opened and closed by the piston to charge the crank chamber with air through the air-feeding port, while charging the air-fuel mixture passageways with air-fuel mixture from the inlet ports through the air-fuel mixture introduction recesses formed in the outer surface of the piston and through the air-fuel mixture outlets, and locating the air-fuel mixture outlets on the side of the inlet ports while locating the air outlets on the side of the exhaust port.

Therefore, the engine needs no reed valve to open and close the air-feeding port. Also, since the crank chamber is directly charged with air through the air-feeding port, it can be charged with a significant amount of air at a time. The charged air can be used to effectively scavenge the cylinder. Further, since the air-fuel mixture outlets are located on the side of the inlet ports while the air outlets are located on the side of the exhaust port, an air layer can be formed between air-fuel mixture discharged in the air-fuel mixture passageways from the air-fuel mixture outlets and combustion gas in the cylinder chamber with the air discharged from the air outlets. The air layer thus formed can effectively prevent "blow-by" of the air-fuel mixture.

Also, since a fresh and easily evaporated air-fuel mixture is normally passed through the air-fuel mixture introduction recesses at a relatively low temperature to remove the heat from the piston and cylinder, it is possible to effectively prevent thermal effects due to the running of the engine.

In a preferred embodiment of the present invention, the air outlets and air-fuel mixture outlets are located at opposite sides of a straight line connecting the air-feeding port and the exhaust port when viewed in a plane. With this positioning of the air outlets and air-fuel mixture outlets on either side of the cylinder, the scavenging of, and charging of the air-fuel mixture in, the cylinder chamber can be brought about uniformly at both sides of the cylinder chamber.

Also, in another preferred embodiment of the present invention, the air outlets and air-fuel mixture outlets are directed toward the air-feeding port. Thus, the so-called Schnurle scavenging can be performed to prevent the "blow-by of air-fuel mixture" more effectively.

DETAILED DESCRIPTION OF THE INVENTION

A currently preferred embodiment will be described in detail below with reference to the accompanying drawings.

Figure 1:
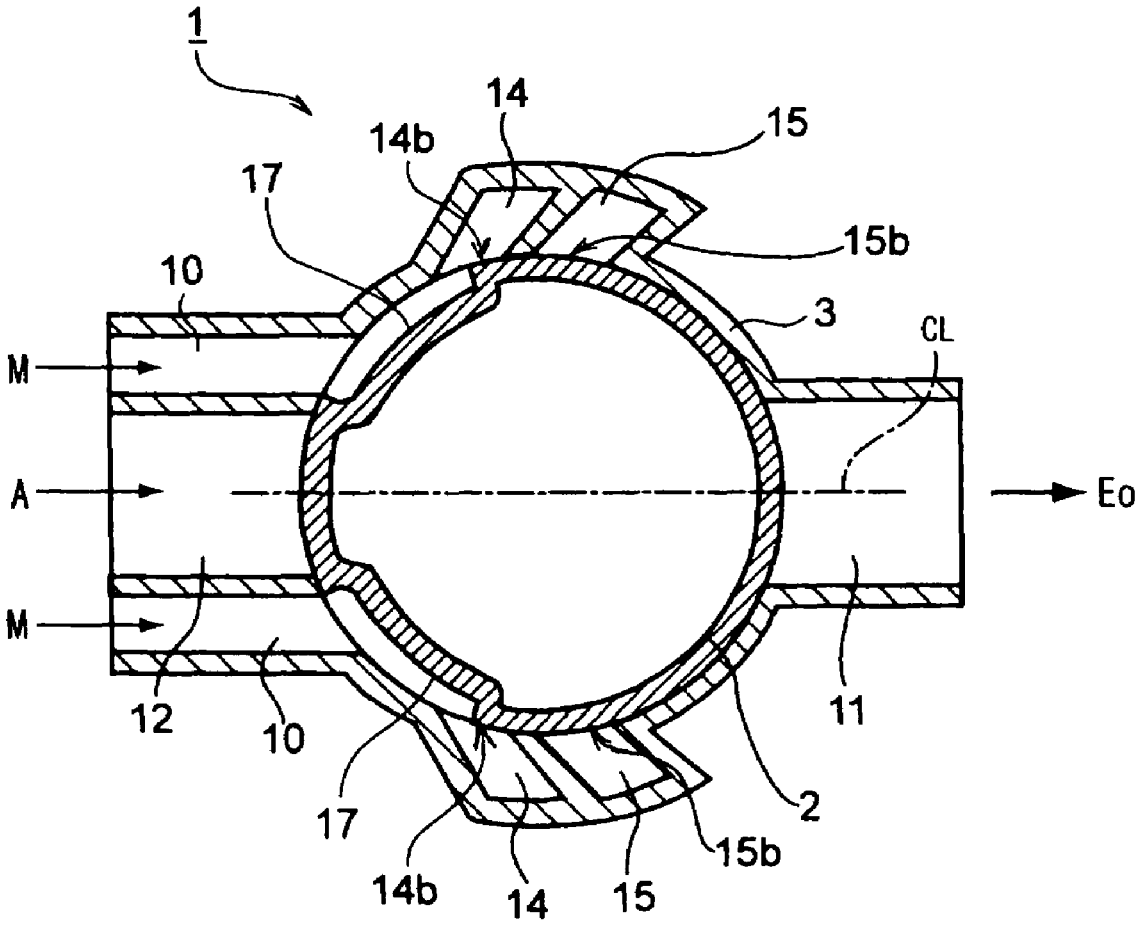
FIG. 1 is a cross-sectional view of a two-stroke internal combustion engine according to embodiments of the present invention, taken along the I-I line of FIG. 2 to show the internal structure of the engine.
Figure 2:
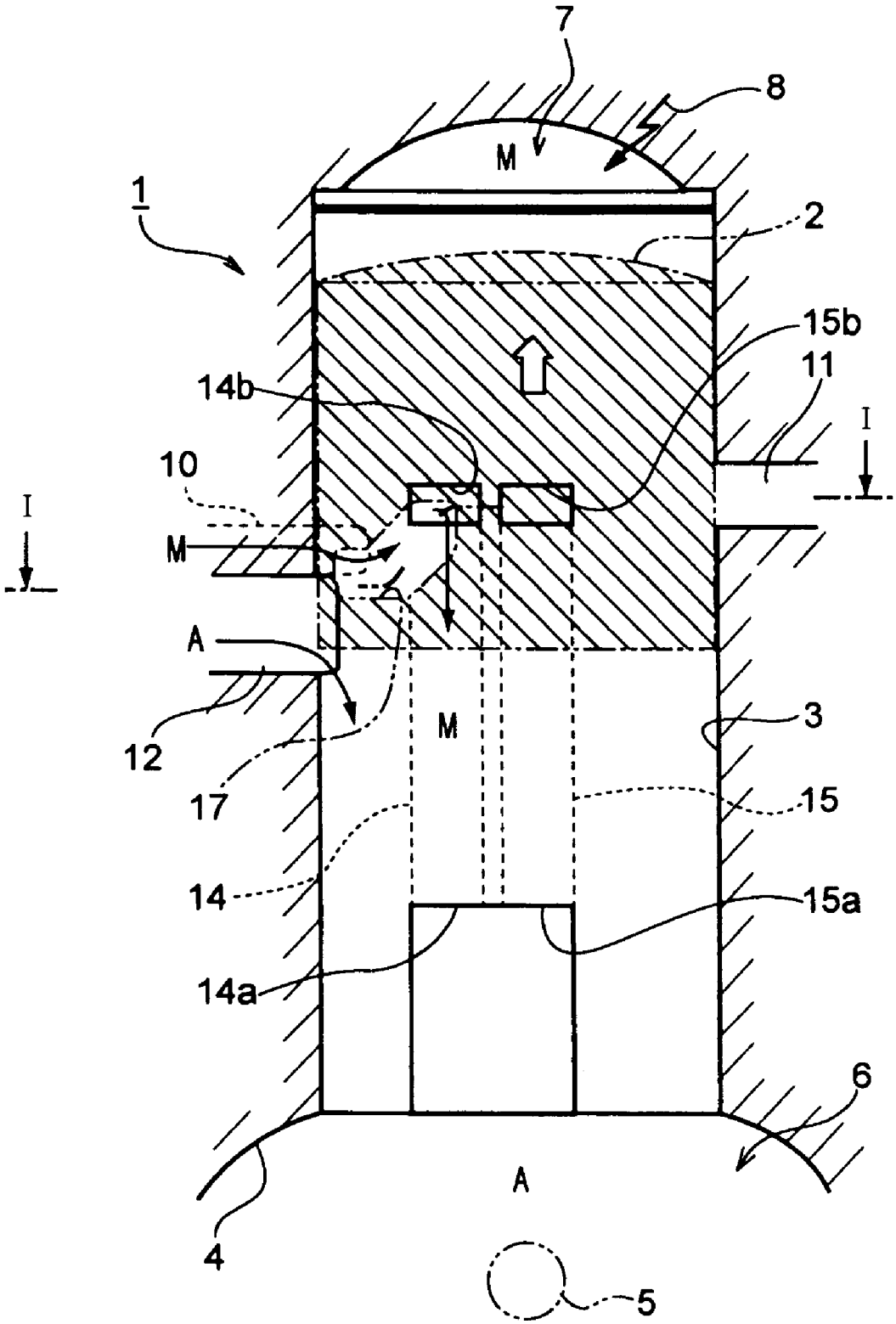
FIG. 2 is a diagram illustrating that the crank chamber is charged with air in a compression stroke of the two-stroke internal combustion engine according to embodiments of the present invention and air-fuel mixture passageways are charged with an air-fuel mixture from inlet ports via the piston.
Figure 3:
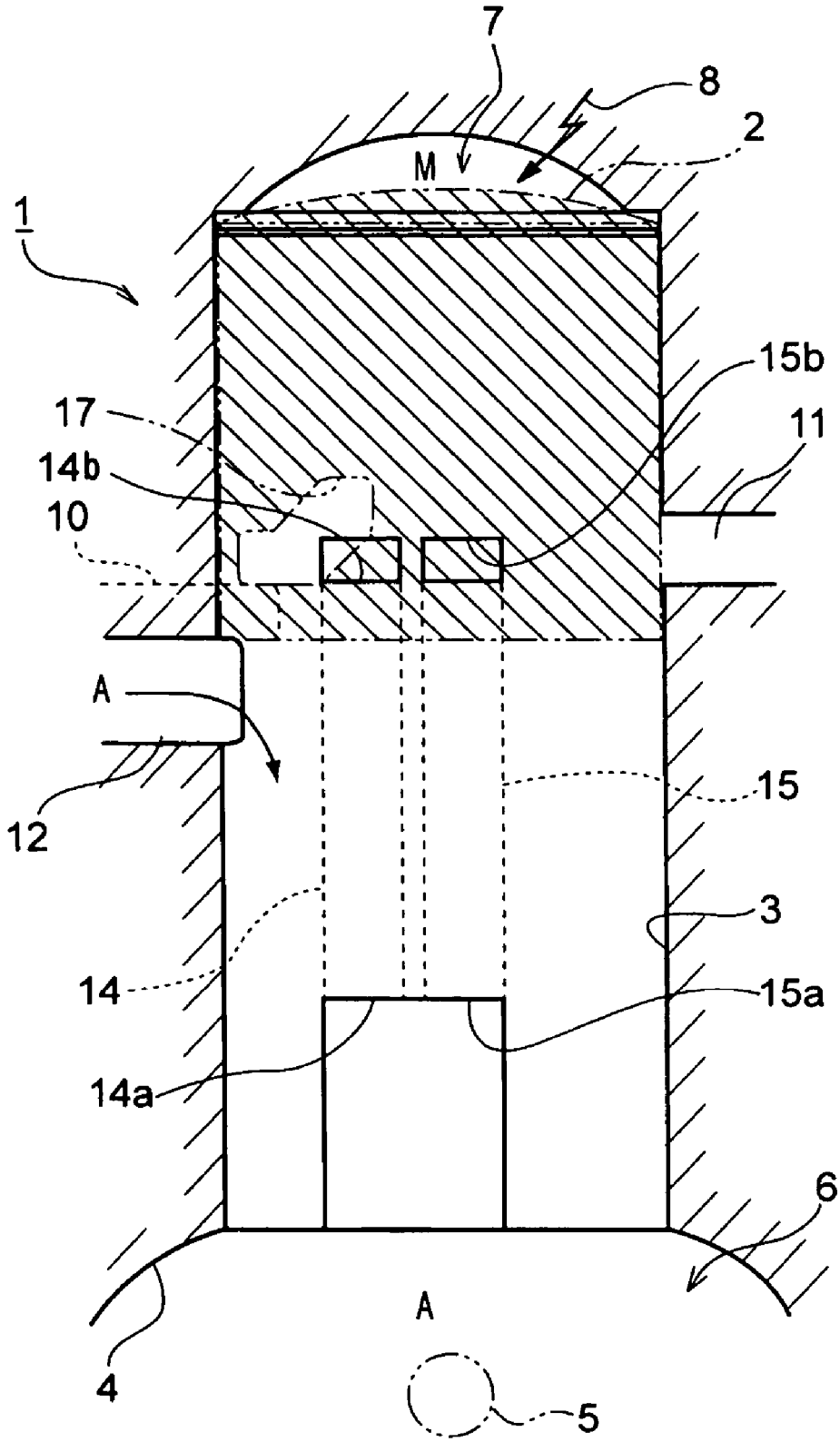
FIG. 3 is a diagram illustrating that the piston of the two-stroke internal combustion engine according to embodiments of the present invention has ascended farther from the position in FIG. 2 to the top dead center.
Figure 4:
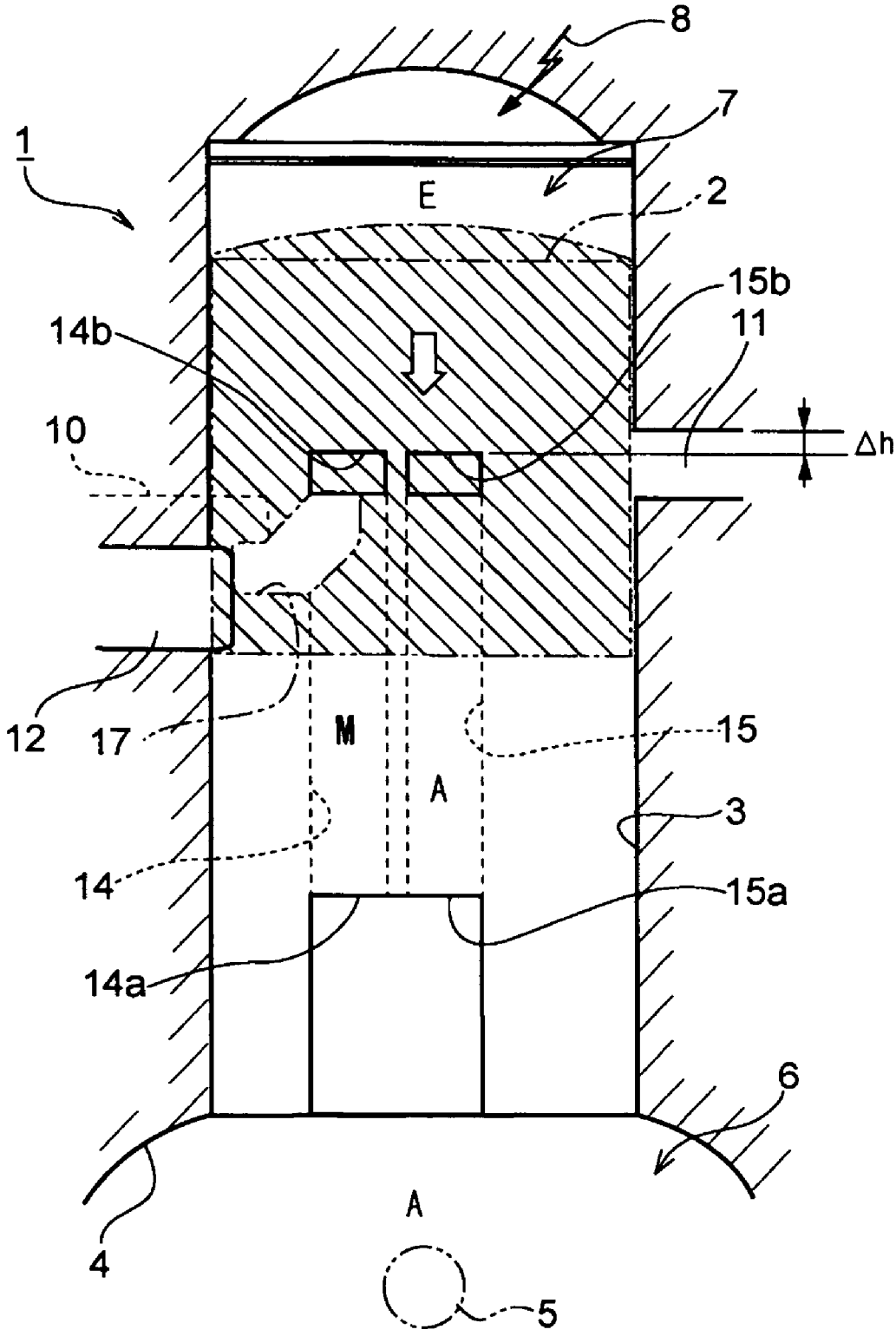
FIG. 4 is a diagram illustrating the two-stroke internal combustion engine according to embodiments of the present invention, in an expansion stroke.

FIGS. 2 to 4 are diagrams illustrating behavior of a two-stroke internal combustion engine according to embodiments of the present invention. FIG. 1 is a cross-sectional view taken along the I-I line of FIG. 2 to illustrate the construction of the engine.

The two-stroke internal combustion engine (hereafter simply referred to as "engine" as well) according to embodiments of the present invention is generally labeled with a reference numeral 1. The engine 1 is of a single-cylinder air-cooled type including a cylinder 3 having a piston 2 fittingly inserted therein, and a crank case 4 joined to the lower end of the cylinder 3. The crank case 4 defines a crank chamber 6 accommodating a crank shaft 5.

A cylinder chamber 7 is defined above the piston 2 and has an ignition plug 8 at the top thereof. The cylinder 3 has formed therein two inlet ports 10 and at least one exhaust port 11 located approximately opposite to the inlet ports 10, respectively. The cylinder 3 also has at least one air-feeding port 12 formed independently between the two inlet ports 10. In other words, the inlet ports 10 are independent from the air-feeding port 12 and located on opposite sides of the air-feeding port 12. The air-feeding port 12 is positioned diametrically opposite from the exhaust port 11 when viewed in a plane.

The inlet ports 10 are connected to a carburetor (not shown) and supply a mixture M of air and fuel with a lubricant (hereafter simply referred to as "air-fuel mixture") from the carburetor to the engine 1. The carburetor is set to produce a air-fuel mixture rich in the fuel component. On the other hand, the engine 1 is supplied with fuel-free air A from the air-feeding port 12.

The engine 1 also has air-fuel mixture passageways 14 and air passageways 15 adjacent to each other and extending in the up and down direction in the cylinder 3. These air-fuel mixture passageways 14 and air passageways 15 are opened at their lower ends 14*a* and 15*a* as fluid inlets to the crank chamber 6. The upper ends of the passageways 14 and 15 open to the cylinder chamber 7 to serve as fluid inlets 14*b* and fluid outlets 15*b*, respectively.

When viewed in a plane, a pair of the air-fuel mixture outlet 14*b* and the air outlet 15*b* is located on one side of a straight line CL connecting the air-feeding port 12 and the exhaust port 11, whereas another pair of the air-fuel mixture outlet 14*b* and the air outlet 15*b* is located on the other side of the same line CL, as shown in FIG. 1. The air outlets 15*b* are positioned nearer to the exhaust port 11, while the air-fuel mixture outlets 14*b* are positioned farther from the exhaust port 11, i.e., nearer to the inlet ports 10. Although it is not essential, the air-fuel mixture outlets 14*b* and the air outlets 15*b* located on opposite sides of the cylinder 3 with respect to the line CL are preferably directed in a direction away from the exhaust port 11 and toward the air-feeding port 12.

In the two-stroke internal combustion engine 1, all of the inlet ports 10, exhaust port 11, air-feeding port 12, air-fuel mixture outlets 14*b* at the upper ends of the air-fuel mixture passageways 14 and air-outlets 15*b* at the upper ends of the air passageways 15 are closed and opened by up and down movement of the piston 2. The air-feeding port 12 and inlet ports 10 are opened when the piston 2 ascends in the compression stroke and a negative pressure is produced in the crank chamber 6 (see FIG. 2). As a result, the crank chamber 6 is directly charged with fuel-free air through the air-feeding port 12. Also, the inlet ports 10 are opposed to lower ends of two air-fuel mixture introduction recesses 17 formed in the outer surface of the skirt portion of the piston 2. In this state, upper ends of the air-fuel mixture introduction recesses 17 communicate with the air-fuel mixture passageways 14 via the air-fuel mixture outlets 14*b*. Thus, the mixture M is charged into the air-fuel mixture passageways 14 from the inlet ports 10 via the piston 2. The air-feeding port 12 is kept open until the piston 2 ascends to and reaches the top dead center. On the other hand, the inlet ports 10 are closed by the piston 2 having nearly reached the top dead center (FIG. 3).

Slightly before the piston 2 reaches the top dead center, the ignition plug 8 ignites the compressed mixture M in the cylinder chamber 7. The ignition begins the expansion stroke of the two-stroke internal combustion engine 1. In the expansion stroke in which the piston 2 descends, the piston 2 closes all of the inlet ports 10, exhaust port 11, air-feeding port 12, air-fuel mixture outlets 14*b* at the upper ends of the air-fuel mixture passageways 14 and air-outlets 15*b* at the upper ends of the air passageways 15 as shown in FIG. 4. As the piston 2 descends, the pressure in the crank chamber 6 increases.

Figure 5:
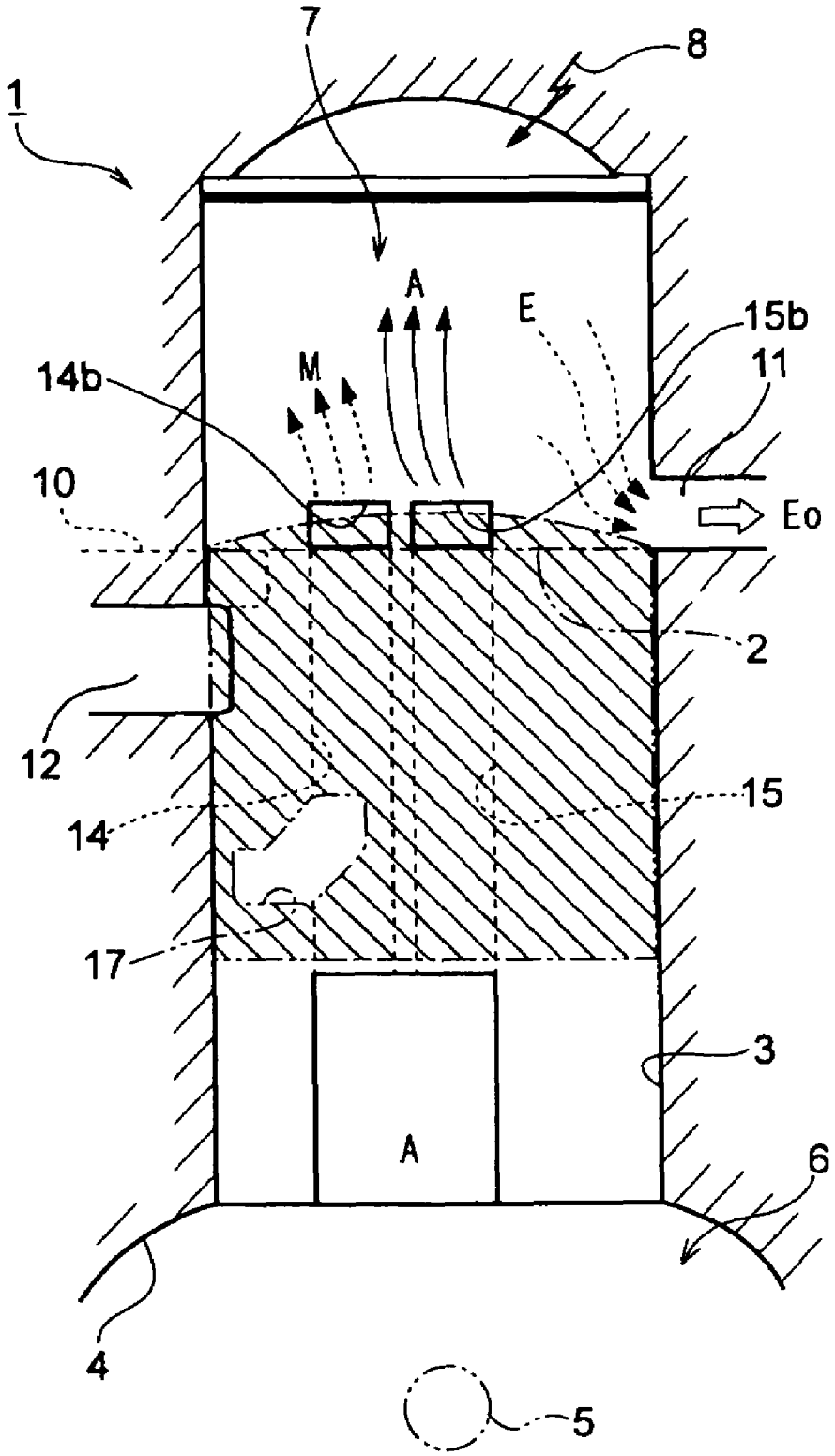
FIG. 5 is a diagram showing the two-stroke internal combustion engine according to embodiments of the present invention in an exhaust stroke (with the piston at the bottom dead center).

As the piston 2 descends farther, only the exhaust port 11 is opened as shown in FIG. 5. At this point, the exhaust stroke begins, and burnt or combustion gas E in the cylinder chamber 7 is discharged outside as exhaust gas $E_0$ through the exhaust port 11 as shown in FIG. 5. Upper ends of the air-fuel mixture outlets 14*b* and air outlets 15*b* are at a level slightly lower (by Δh as shown in FIG. 4) than the upper end of the exhaust port 11. Therefore, the exhaust port 11 is first opened, and the air-fuel mixture outlets 14*b* and air outlets 15*b* are next opened.

Once the air-fuel mixture outlets 14*b* and air outlets 15*b* are opened, air A in the crank chamber 6 and air passageways 15 and mixture M in the air-fuel mixture passageways 14 simultaneously enter into the cylinder chamber 7 through the air-fuel mixture outlets 14*b* and air outlets 15*b*. FIG. 5 shows that the piston 2 is positioned near the bottom dead center at this point.

Since the air-fuel mixture outlets 14*b* and air outlets 15*b* are directed toward the air-feeding port 12 that is located opposite from the exhaust port 11 as explained before, the cylinder chamber 7 can be scavenged by Schnurle scavenging (or reversal scavenging). That is, the mixture M and air A discharged from the air-fuel mixture outlets 14*b* and air outlets 15*b* flow in a direction away from the exhaust port 11, and then hit the inner wall of the cylinder 3. Thus, the flow of mixture M and air A is reversed in direction to run toward the exhaust port 11. The reversed flow toward the exhaust port 11 may be used to effectively expel the combustion gas E as exhaust gas $E_0$ outside the cylinder chamber 7 through the exhaust port 11.

As shown in FIGS. 1 and 5, the air outlets 15*b* are positioned nearer to the exhaust port 11, while the air-fuel mixture outlets 14*b* are positioned farther from the exhaust port 11. Thus, the air A discharged from the air outlets 15*b* forms an air layer serving as a buffer layer between the combustion gas E in the cylinder chamber 7 and mixture M discharged from the air-fuel mixture outlets 14*b* (as shown for example in FIG. 5). Therefore, stratified-scavenging can effectively prevent "blow-by of air-fuel mixture". After the piston 2 further descends to exhaust the combustion gas E from the cylinder chamber 7 to the end of the exhaust stroke, the piston 2 again ascends from the bottom dead center. At this point, the compression stroke begins.

According to the above embodiments, the stratified-scavenging can be done completely under the control of the piston 2 without using any valve mechanism such as a reed valve, unlike the system for example described in Patent Document 2. Therefore, the two-stroke internal combustion engine 1 includes no components that increase its scale and weight in this regard. Also, feeding air A directly into the crank chamber 6 contributes to introducing into the crank chamber 6 a sufficient amount of air to effectively scavenge the cylinder chamber 7. Therefore, it is possible to prevent an unburnt portion of mixture M from being discharged directly outside through the exhaust port 11, and to thereby reduce the amount of harmful components in the exhaust gas $E_0$ significantly.

Also, since the mixture M is charged into the air-fuel mixture passageways 14 from the inlet ports 10 via the air-fuel mixture introduction recesses 17 formed in the outer surface of the piston 2, the piston 2 can be cooled by the fuel-rich mixture M passing through the air-fuel mixture introduction recesses 17. Since the piston 2 can be made from an aluminum alloy that is a light metal, cooling is one of most advantageous factors for enhancing the durability of the piston 2 and its peripheries. Additionally, engine performance can be assured by setting an appropriate concentration of the air-fuel mixture, depending upon the acceptable total capacity of the air-fuel mixture passageways 14.

What is claimed is:

1. A two-stroke internal combustion engine, comprising:

a cylinder chamber and a crank chamber defined by a piston fittingly inserted in a cylinder;

a plurality of air-fuel mixture passageways having air-fuel mixture outlets open to the cylinder chamber to provide communication between the cylinder chamber and crank chamber;

a plurality of air passageways having air outlets open to the cylinder chamber to provide communication between the cylinder chamber and crank chamber;

at least one air-feeding port to feed air into the crank chamber;

a plurality of inlet ports to supply an air-fuel mixture from the air-fuel mixture outlets to the air-fuel mixture passageways through air-fuel mixture introduction recesses formed in the outer surface of the piston; and at least one exhaust port located diametrically opposite from the air-feeding port to discharge combustion gas outside from the cylinder chamber, each of the air-fuel mixture outlets, the air outlets, the air-feeding port, the inlet ports and the exhaust port being opened and closed by the piston;

the air-fuel mixture outlets being located nearer to the inlet ports than the exhaust port, and the air outlets being located nearer to the exhaust port than the inlet ports;

in each compression stroke of the piston, air being charged into the crank chamber from the air-feeding port, and air-fuel mixture being charged into the air-fuel mixture passageways from the inlet ports through the air-fuel mixture introduction recesses of the piston and air-fuel mixture outlets; and in each exhaust stroke in which the exhaust port is opened, the air passageways and the air-fuel mixture passageways being opened such that air is supplied into the cylinder chamber from the crank chamber through the air passageways and the air outlets to interpose between the air-fuel mixture having entered into the cylinder chamber from the air-fuel mixture passageways through the air-fuel mixture outlets and the combustion gas in the cylinder chamber.

2. The two-stroke internal combustion engine according to claim 1, wherein the air outlets and the air-fuel mixture outlets are located at opposite sides of a straight line connecting the air-feeding port and the exhaust port when viewed in a plane.

3. The two-stroke internal combustion engine according to claim 2, wherein the air outlets and the air-fuel mixture outlets are directed toward the air-feeding port.

4. The two-stroke internal combustion engine according to claim 1, wherein the piston comprises an aluminum alloy.

5. The two-stroke internal combustion engine according to claim 1, wherein the piston is cooled by the air-fuel mixture passing through the air-fuel mixture introduction recesses.

6. The two-stroke internal combustion engine according to claim 1, wherein said two-stroke internal combustion engine does not include a reed valve.

7. A two-stroke internal combustion engine, comprising:

a cylinder chamber and a crank chamber defined by a piston fittingly inserted in a cylinder;

a plurality of air-fuel mixture passageways having air-fuel mixture outlets open to the cylinder chamber to provide communication between the cylinder chamber and crank chamber;

a plurality of air passageways having air outlets open to the cylinder chamber to provide communication between the cylinder chamber and crank chamber;

at least one air-feeding port to feed air into the crank chamber;

a plurality of inlet ports to supply an air-fuel mixture from the air-fuel mixture outlets to the air-fuel mixture passageways through air-fuel mixture introduction recesses formed in an outer surface of the piston; and at least one exhaust port located diametrically opposite from the air-feeding port to discharge combustion gas outside from the cylinder chamber, each of the air-fuel mixture outlets, the air outlets, the air-feeding port, the inlet ports and the exhaust port being opened and closed by the piston;

the air-fuel mixture outlets being located nearer to the inlet ports than the exhaust port, and the air outlets being located nearer to the exhaust port than the inlet ports;

in each compression stroke of the piston, air being charged into the crank chamber from the air-feeding port, and air-fuel mixture being charged into the air-fuel mixture passageways from the inlet ports through the air-fuel mixture introduction recesses of the piston and air-fuel mixture outlets; and in each exhaust stroke in which the exhaust port is opened, the air passageways and the air-fuel mixture passageways being opened to scavenge the cylinder chamber with air supplied into the cylinder chamber from the crank chamber through the air passageways and the air outlets between the air-fuel mixture supplied into the cylinder chamber from the air-fuel mixture passageways through the air-fuel mixture outlets and the combustion gas in the cylinder chamber.

8. The two-stroke internal combustion engine according to claim 7, wherein the air discharged from the air outlets forms a buffer layer between the combustion gas in the cylinder chamber and the air-fuel mixture discharged from the air-fuel mixture outlets.

* * * * *